US006625412B2

(12) United States Patent
Takami et al.

(10) Patent No.: US 6,625,412 B2
(45) Date of Patent: Sep. 23, 2003

(54) CHARGING MEMBER FOR CHARGING MEMBER TO BE CHARGED, CHARGING DEVICE, AND PROCESS CARTRIDGE

(75) Inventors: Norio Takami, Tokyo (JP); Miyuki Oki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/106,317

(22) Filed: Mar. 27, 2002

(65) Prior Publication Data

US 2002/0197081 A1 Dec. 26, 2002

(30) Foreign Application Priority Data

Mar. 29, 2001 (JP) ..... 2001/095152

(51) Int. Cl.[7] ..... G03G 15/02
(52) U.S. Cl. ..... 399/176; 361/225; 492/56
(58) Field of Search ..... 399/174, 176; 361/225; 492/56

(56) References Cited

U.S. PATENT DOCUMENTS 4,851,960 A 7/1989 Nakamura et al. ..... 361/225
5,834,116 A * 11/1998 Sawa et al. ..... 492/56
5,863,626 A * 1/1999 Yamasaki ..... 492/56

FOREIGN PATENT DOCUMENTS

JP 63-149669 6/1988
JP 8-50390 A * 2/1996

* cited by examiner

*Primary Examiner*—Joan Pendegrass
(74) *Attorney, Agent, or Firm*—Fitzpatrick, Cella, Harper & Scinto

(57) ABSTRACT

A charging member for charging a member to be charged includes: an electrically conductive member to which a voltage is applicable; and a coating layer that coats the electrically conductive member, in which when a d.c. voltage of |10| to |300| (V) is applied to the electrically conductive member, the following relationship is satisfied: Z/Ra is 0.7 or less, where Z is the standard deviation of a resistance of the charging member, and Ra is an average value of the resistance of the charging member.

24 Claims, 3 Drawing Sheets

CHARGING MEMBER FOR CHARGING MEMBER TO BE CHARGED, CHARGING DEVICE, AND PROCESS CARTRIDGE

BACKGROUND OF THE INVENTION

1. Field of the Invention

The present invention relates to a charging member that charges a member to be charged such as a photosensitive member or dielectric, a charging device and a process cartridge that is detachably mountable onto a main body of an image forming apparatus such as an electrophotographic copying machine or a printer.

2. Description of Related Art

In an image forming apparatus of an electrophotographic process or an electrostatic recording process, in recent years, as a charging means for uniformly charging an image bearing member such as an electrophotographic photosensitive member or an electrostatic recording dielectric or other members to be charged to a predetermined polarity and potential, a charging device of a contact charging system which allows an electrically conductive charging member (contact charging member) to which a voltage is applied to be abutted against the member to be charged to charge the member to be charged has been put in practical use since such a charging device has the advantages such that ozone is low and a power is low as compared with a corona charger that is of a non-contact type.

In particular, a contact charging device of a roller charging system which uses an electrically conductive elastic roller (hereinafter referred to as "charging roller") as the contact charging member, brings the charging roller into pressure contact with the member to the charged, and applies a voltage to the member to be charged, thereby charging the member to be charged is preferably used from the viewpoint of the charging stabilization.

More specifically, charging starts by applying a voltage of a predetermined threshold voltage or higher because charging is conducted by discharging from the charging roller to the member to be charged.

For example, in the case where the charging roller is brought into pressure contact with an electrophotographic OPC photosensitive member which is 25 $\mu$m in thickness as the member to be charged to conduct a charging process, when a voltage (threshold voltage) of about 600 V is applied to the charging roller, the surface potential of the photosensitive member starts to go up, and thereafter a photosensitive member surface potential increases linearly with a slope of a line with respect to an applied voltage being 1 (one). In the following description, that threshold value is defined as "charging start voltage Vth".

That is, in order to obtain a photosensitive member surface potential VD (dark section potential) required for image formation, it is necessary to apply a d.c. voltage of VD+Vth to the charging roller. A contact charging system in which only the d.c. voltage is applied to the contact charging member to charge the member to be charged is called "d.c. charging system".

There is also "a.c. charging system" in which an oscillation voltage resulting from superimposing an a.c. voltage having a peak-to-peak voltage of 2×Vth or higher on the d.c. voltage corresponding to a desired surface potential VD of the member to be charged is applied to the contact charging member to charge the member to be charged as disclosed in Japanese Patent Application Laid-Open No. 63-149669.

The above a.c. charging system is proposed for the purpose of leveling the potential due to the a.c. voltage, and the surface potential of the photosensitive member which functions as the member to be charged converges on the intermediate point of a peak voltage as the photosensitive member gets further away from the contact charging member. The a.c. charging system has the disadvantages in that the high-voltage costs increase and the photosensitive member is damaged (scratched out).

The d.c. charging system is excellent in view of less increase in the high-voltage costs or less damage (scratching) of the photosensitive member but has the disadvantage in that the uniformity of the charging is insufficient as compared with the a.c. charging system. In an image forming apparatus of the transfer type that uses the contact charging device of the d.c. charging system as a photosensitive member charging process means, it is necessary to dispose a charge eliminating means (potential control means) such as a pre-exposure device in order to make uniform the surface potential of the photosensitive member which is nonuniform after the photosensitive member has passed through a transferring portion between the transferring portion and the charging portion of the photosensitive member.

In the case where a charge eliminating means such as a pre-exposure device is omitted, in low-temperature and low-humidity environments (temperature of 12 to 17° C., humidity of 5 to 15%, hereinafter referred to as "L/L environments")? when a halftone image is outputted in a state where the surface potential of the photosensitive member which has been disturbed by the transferring portion cannot be made uniform by the charging roller, a transversal streak unevenness remarkably occurs.

SUMMARY OF THE INVENTION

An object of the present invention is to provide a charging member, a charging device and a process cartridge capable of conducting uniform charging in a d.c. charging system.

Another object of the present invention is to provide a charging member, a charging device and a process cartridge, which are suitable for a simple structure having no charge eliminating means such as a pre-exposure device.

Still another object of the present invention is to provide a charging member, a charging device and a process cartridge, which are capable of conducting charging without unevenness when a halftone image is outputted under low-temperature and low-humidity environments.

Yet still another object of the present invention is to provide a charging member, a charging device and a process cartridge, which do not produce transversal streak unevenness.

Other objects and features of the present invention will be apparent when reading the following detailed description with reference to the accompanying drawings.

DESCRIPTION OF THE PREFERRED EMBODIMENTS

Now, a description will be given in more detail of preferred embodiments of the present invention with reference to the accompanying drawings.

(1) The overall structure of an image forming apparatus example

Figure 1:
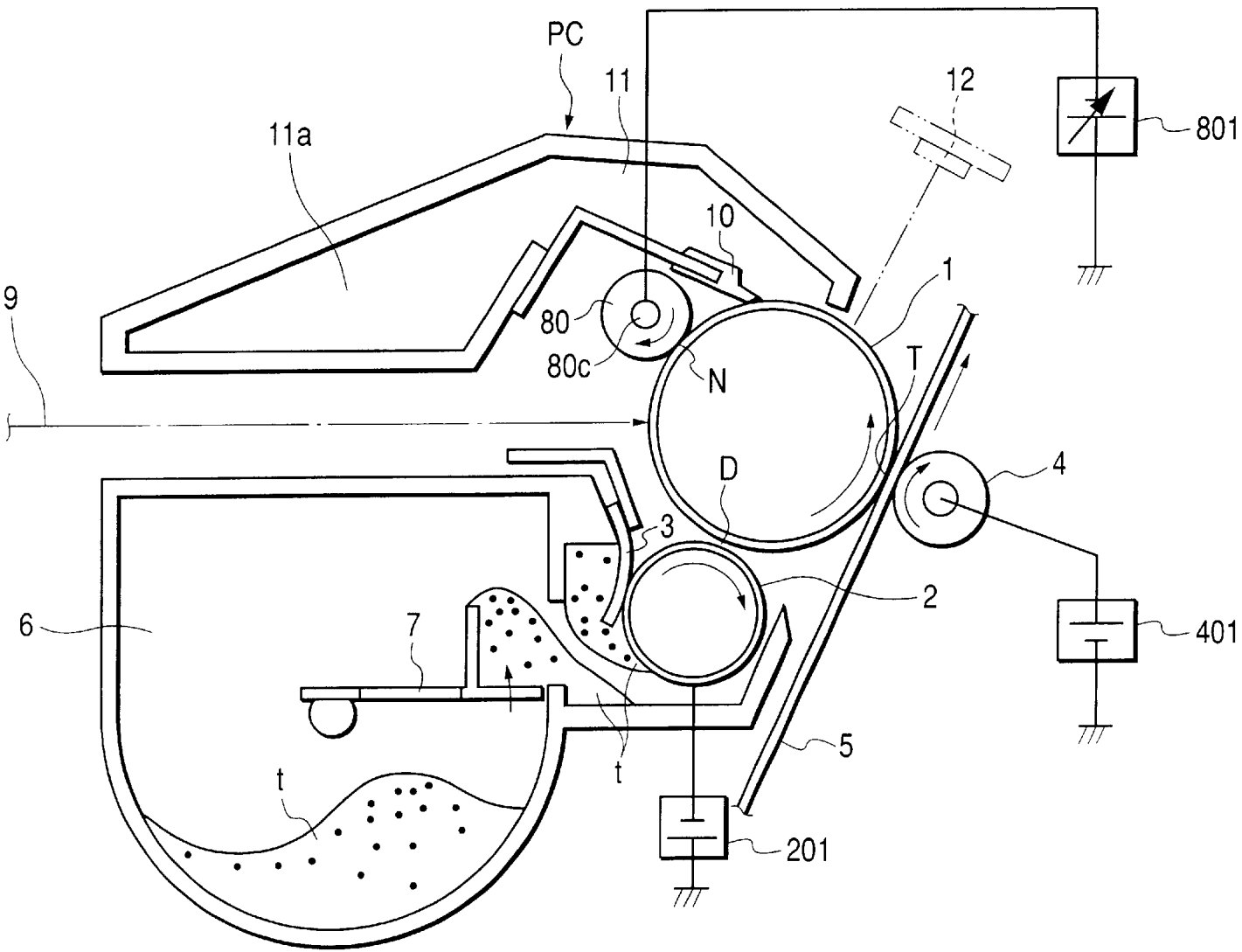
FIG. 1 is a schematic diagram showing the structure of a main portion of an image forming apparatus in accordance with an embodiment.

FIG. 1 is a schematic diagram showing the structure of an example of an image forming apparatus in accordance with the present invention.

The image forming apparatus according to the embodiment is directed to a laser beam printer that uses a transfer electrophotographic process and is of the roller charging system, the d.c. charging system, the reversal developing system and the process cartridge system, without requiring a charge eliminating means such as a pre-exposure device or a potential control means.

A rotary drum-shaped electrophotographic photosensitive member 1 (hereinafter referred to as "photosensitive drum") that functions as an image bearing member (a member to be charged) is rotationally driven at a predetermined process speed (peripheral speed), at 94.2 mm/sec in the example in a counterclockwise direction indicated by an arrow.

The photosensitive drum 1 in the embodiment is directed to an organic photoconductor resulting from sequentially stacking a charge generation layer and a charge transport layer on an electrically conductive substrate such as an aluminum drum, and an electrostatic capacity of the charge transport layer per an area of 1 $cm^2$ ranges from 1.5 pF to 6.0 pF. When the electrostatic capacity per an area of 1 $cm^2$ is smaller than 1.5 pF, it becomes difficult to conduct the sufficiently uniform charging, whereas when the electrostatic capacity is larger than 6.0 pF, a voltage that is applied to the interior of the charge transport layer is too large, thereby leading to leakage. In the potential setting used generally, it is preferable to set the film thickness of the photosensitive drum, that is, the thickness of the charge transport layer is 5 to 20 $\mu$m. That is, it is preferable to set the thickness of the charge transport layer to be larger than 5 $\mu$m from the viewpoint of preventing the current leakage to a fine defect of the photosensitive drum, and to be equal to or lower than 20 $\mu$m in order to improve the charge uniformity by increasing the charge density. In the example, the thickness of the charge transport layer of the photosensitive drum 1 is set to 15 $\mu$m.

The charging roller 80 that functions as the contact charging member is directed to an electrically conductive elastic roller, which is 12 mm in diameter and 230 mm in the surface length in the longitudinal direction resulting from coating at least an elastic layer on the periphery of a core metal (electrically conductive shaft) 80*c* which is 6 mm in diameter. The charging roller 80 in the embodiment is directed to a multi-layer roller obtained by laminating an elastic layer, a dielectric layer and a surface layer on the outer periphery of the electrically conductive shaft 80*c*. That is, the elastic layer, the dielectric layer and the surface layer constitute a coating layer of the shaft 80*c*.

The charging roller 80 is disposed in parallel with a shaft of the photosensitive drum 1 in such a manner that both end portions of the core metal 80*c* is rotatably supported by a bearing member (not shown), and the charging roller 80 is brought into pressure contact with the surface of the photosensitive drum 1 by a pressing means (not shown) under one side pressure of 3.4 to 14.7 N (350 to 1,500 g•f) due to a predetermined uniform pressing force in the longitudinal direction. With this structure, the charging roller 80 is rotated in association with the rotation of the photosensitive drum 1. An abutment portion of the photosensitive drum 1 with the charging roller 80 is a charging portion (charging nip portion) N.

A predetermined charging bias is applied to the charging roller 80 from a charging bias applying power source 801 disposed in the main body of the image forming apparatus, to thereby charge the surface of the photosensitive drum 1 to a predetermined polarity/potential in a contacting manner. The embodiment is of the d.c. charging system in which a d.c. voltage of −1,250 V is applied to the charging roller 80 from the charging bias applying source 801 (without applying an a.c. voltage) to charge the surface of the photosensitive drum 1 to the charging potential (dark section potential) of −700 V in a contacting manner.

It is preferable to set the voltage applied to the charging roller 80 to be −1,000 V or lower in order to improve the charge uniformity due to an enlarged charge density, and also to be −1,500 V or higher in order to prevent the current leakage to fine defects in the photosensitive drum. That is, it is preferable to set the absolute value of the applied voltage at 1,000 V to 1,500 V.

The charging-processed surface of the photosensitive drum 1 is exposed by a laser beam 9 outputted from an exposure means (not shown) which functions as a latent image forming means, for example, a laser beam scanner projecting a laser beam in a scanning manner, with the results that the charge potential (bright section potential) of the exposure portion of the photosensitive drum 1 in the embodiment decays to −150 V, and an electrostatic image of image information corresponding to the scanning exposure pattern is formed on the peripheral surface of the rotating photosensitive drum 1 due to a potential contrast with the dark section potential.

In the embodiment, the electrostatic latent image on the surface of the photosensitive drum 1 is reversal developed by negative charged toner in a developing portion D by the developing device 6. A developing sleeve 2 that functions as a developer bearing member which is close to or in contact with the photosensitive drum 1 is rotatably driven at a predetermined peripheral speed clockwise as indicated by an arrow. A portion of the developing sleeve 2 which is close to or in contact with the surface of the photosensitive drum 1 is directed to the developing portion D.

A doctor blade 3 made of urethane rubber or the like and having a base end fitted to a developing sleeve container is in elastic pressure contact with the developing sleeve 2, and the thickness of the toner layer on the surface of the developing sleeve 2 is set to a predetermined uniform value of 0.4 mg/$cm^2$ by the doctor blade 3. A developer (toner) t reserved in the developer container is agitated by an agitating member 7, and a part of the developer t is supplied to the developing sleeve container and then coated on the developing sleeve 2 by the doctor blade 3.

Also, a predetermined developing bias, −500 V in the example is applied to the developing sleeve 2 by a developing bias applying power source 201.

The developer (toner) to be used may be magnetic toner, non-magnetic toner, polymer toner or pulverized toner.

The electrically conductive elastic transfer roller 4 that functions as a transfer means is disposed in parallel with the photosensitive drum 1 and abutted against the photosensitive drum 1 by a predetermined contact pressure, and rotates in the forward direction with respect to the rotation of the photosensitive drum 1 at substantially the same peripheral speed as the rotating peripheral speed of the photosensitive drum 1. An abutment portion of the photosensitive drum 1 with the transfer roller 4 forms a transferring portion (transfer nipping portion) T. Then, a transfer material 5 fed from a sheet feeding portion (not shown) is introduced into the transferring portion T at a predetermined control timing and nipped and conveyed by the transferring portion T. During that operation, a predetermined transfer bias reverse to the charging polarity of toner is applied to the transfer roller 4 by the transfer bias applying power source 401 so that the toner image on the side of the surface of the photosensitive drum 1 is transferred onto the surface of the transfer material P in an electrostatic manner.

The transfer material 5 which is nipped and conveyed by the transferring portion T and subjected to the transfer of the toner image is stripped from the surface of the photosensitive drum 1 and then introduced into an image fixing means (not shown). Then, the transfer material 5 is subjected to an image fixing process and discharged as an image formed substance.

Also, the surface of the photosensitive drum 1, from which the toner image has been transferred onto the transfer material 5, is subjected to the removal of a contaminant stuck on the surface of the photosensitive drum 1, such as transfer residual toner, by a cleaning device 11 so as to be cleaned, and is repeatedly subjected to image formation. The cleaning device 11 is of the blade system in the example, and the contaminator stuck onto the surface of the photosensitive drum 1 such as transfer residual toner is scraped off by the cleaning blade 10 and then collected in a waste toner container 11*a*. The surface of the photosensitive drum 1 that has been cleaned is charged by the charging roller 80 without being charge-eliminated by a charge eliminating means such as a pre-exposure device. That is, there is disposed no charge eliminating means in a rotational direction of the photosensitive drum 1, which eliminates charges from the photosensitive drum 1 and downstream of the transfer device and upstream of the charging roller 80.

In the printer of the example, four process devices consisting of the photosensitive drum 1, the charging roller 80, the developing device 6 and the cleaning device 11 are integrated together into a process cartridge PC that is exchangeable and detachable from and mountable to the printer main body (image forming apparatus main body). The process cartridge PC is mounted on the printer main body in a predetermined manner so as to be mechanically and electrically connected to the printer main body. As shown in FIG. 1, power sources 201, 401 and 801 are disposed on the printer main body.

The process cartridge PC is designed such that the image bearing member and the charging member are put integrally into a cartridge, and the cartridge is detachably mountable to the image forming apparatus main body. Alternatively, the process cartridge PC may incorporate one or a plurality of other process means such as the developing means and the cleaning means, and be detachably mountable to the image forming apparatus main body.

(2) Method of measuring V-R characteristic of the charging roller and the coefficient of variation Referring to FIG. 1, a member 12 indicated by a double-dotted line represents the pre-exposure device that functions as a conventional charge eliminating means, which is disposed between the transferring portion T and the charging portion N and is used to make uniform the surface potential of the photosensitive drum 1 which has been disturbed after passing the transferring portion T. As described above, when a d.c. charging regimen is used without the provision of the charge eliminating means 12 such as the pre-exposure device, when a halftone image is outputted under an L/L environment, transversal streak unevenness occurs. That is, in the image forming apparatus employing the d.c. charging system, in the case where the charge eliminating means 12 such as the pre-exposure device is omitted from the apparatus, because the surface potential of the photosensitive drum that has been disturbed at the transferring portion under the L/L environment cannot be made uniform by the charging roller, and when the halftone image is outputted, the transversal streak unevenness remarkably occurs.

The present invention makes it possible that by using a charging roller whose coefficient of variation S of the V-R characteristic is 0.70 or lower, which is measured with a method of measuring the V-R characteristic of the charging roller which will be described below, a uniform charging property having no unevenness can be ensured when the halftone image is outputted, even under the L/L environment, with a simple structure from which the charge eliminating means 12 such as the pre-exposure device is omitted, and there can be prevented current leakage to a fine defect of the non-charging member and satisfactory charging performance is assured.

[V-R characteristic measuring method of the charging roller]

Figure 2:
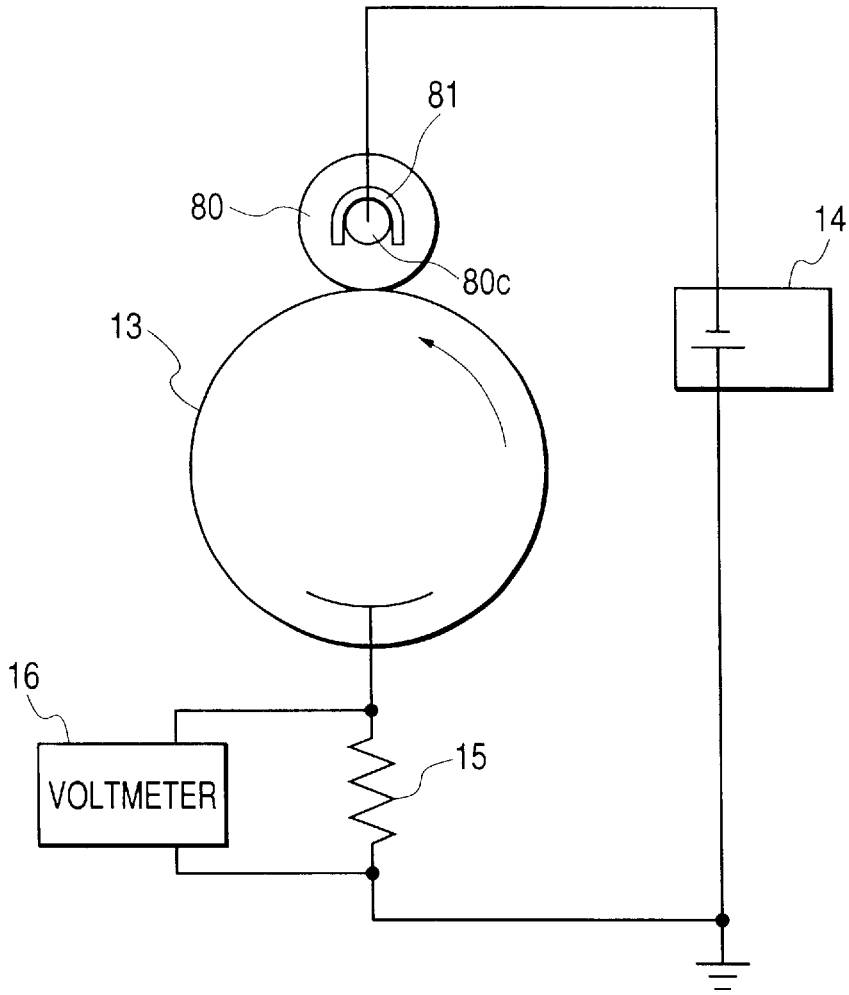
FIG. 2 is an explanatory diagram showing a V-I characteristic measuring method of a charging roller.

FIG. 2 is a schematic diagram showing a measuring device for implementing the V-R characteristic measurement in order to obtain the desired resistance of the charging roller 80.

An electrically conductive drum 13 that functions as a movable electrically conductive member is pivotably supported at a support member (not shown) and is then rotatably driven by a driving means (not shown) at a predetermined peripheral speed counterclockwise as indicated by an arrow.

Figure 3:
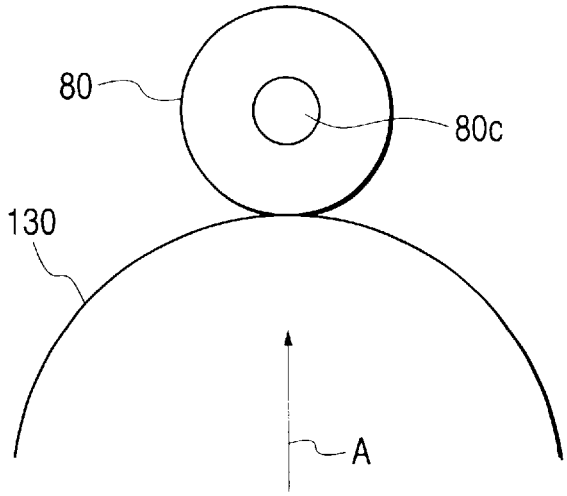
FIG. 3 is an explanatory diagram showing a method of measuring a photosensitive drum abutment area of the charging roller.

The charging roller 80 that functions as an object to be measured is disposed in parallel with a shaft of the electrically conductive drum 13 in such a manner that both end portions of the core metal 80*c* are pivotably supported by a bearing support member 81, and the charging roller 80 is brought into press contact with the electrically conductive drum 13 surface by a predetermined uniform pressing force (total pressure of 3.4 to 14.7 N) in the longitudinal direction caused by a pressing means (not shown) to complete the setting. In order to measure the area of the abutment portion, a semi-cylindrical transparent photosensitive drum 130 (FIG. 3) is prepared, and the charging roller 80 is brought into press contact with the outer surface side of the photosensitive drum 130 by the above uniform press force, and the abutment portion is directly observed from the back surface side of the drum 130 (a direction indicated by an arrow A) by a microscope. As a result, the contact area of the charging roller 80 with the electrically conductive drum 13 differs depending on the charging roller, that is, it ranges from 200 to 250 ($mm^2$). The charging roller 80 is rotated by rotationally driving the electrically conductive drum 13.

The core metal 80*c* of the charging roller 80 is connected to a d.c. power source (a means for applying a constant voltage) 14, and the electrically conductive drum 13 is connected to the ground of the d.c. power supply 14 through a carbon resistor (resistor) 15 of 10 kΩ ($10^4$ Ω). The d.c. power source 14 has a current amplification factor of 20 μA/V and a through-rate of 20 V/μsec or more.

Also, a voltmeter 16 is connected to both ends of the carbon resistor 15 to measure a voltage applied to the carbon resistor 15.

Then, after the above-mentioned device to which the charging roller 80 that functions as the object to be measured is left under the L/L environment (under the environments where the temperature is 12 to 17° C. and the humidity is 5 to 15%) for 24 hours or longer, the electrically conductive drum 13 is rotationally driven at the peripheral speed of 94.2 mm/sec by the driving means (not shown). The charging roller 2 is rotated at the same peripheral speed with the rotational driving of the electrically conductive drum 13.

A d.c. constant voltage E is applied by the d.c. power supply 14. In this situation, a voltage Vr divided by the resistor 15 is measured, and a current Ii that flows from the voltage Vr to the system is obtained by the Ohm's law expression (1).

$$Ii=Vr/10^4 \qquad \text{Expression (1)}$$

The divided voltage of the charging roller 80 is expressed as follows:

$$Vi=E-Vr \qquad \text{Expression (2)}$$

Also, the roller resistor Ri of the charging roller 80 is obtained by the following expression.

$$Ri=(\text{divided voltage to the charging roller: } Vi=E-Vr)/(\text{current value: } Ii) \qquad \text{Expression (3)}$$

In the example, the abscissa axis represents an applied voltage E and the ordinate axis represents a roller resistance Ri.

Through the above method, the measurements are performed at constant voltages, i.e. at seven points of the applied voltage E=−10, −30, −50, −80, −100, −200 and −300 V, to obtain the V-R characteristic (voltage-resistance characteristic) of the charging roller 80.

In the example, in the applied constant voltage $V_{DC}$=|10| to |300| (V) in the above-mentioned V-R characteristic, a voltage larger than 300 V is eliminated, taking the current value (μA) at the time of actual sheet supply into consideration. Also, a voltage smaller than 10 V is eliminated from the viewpoint of measurement precision.

Figure 4:
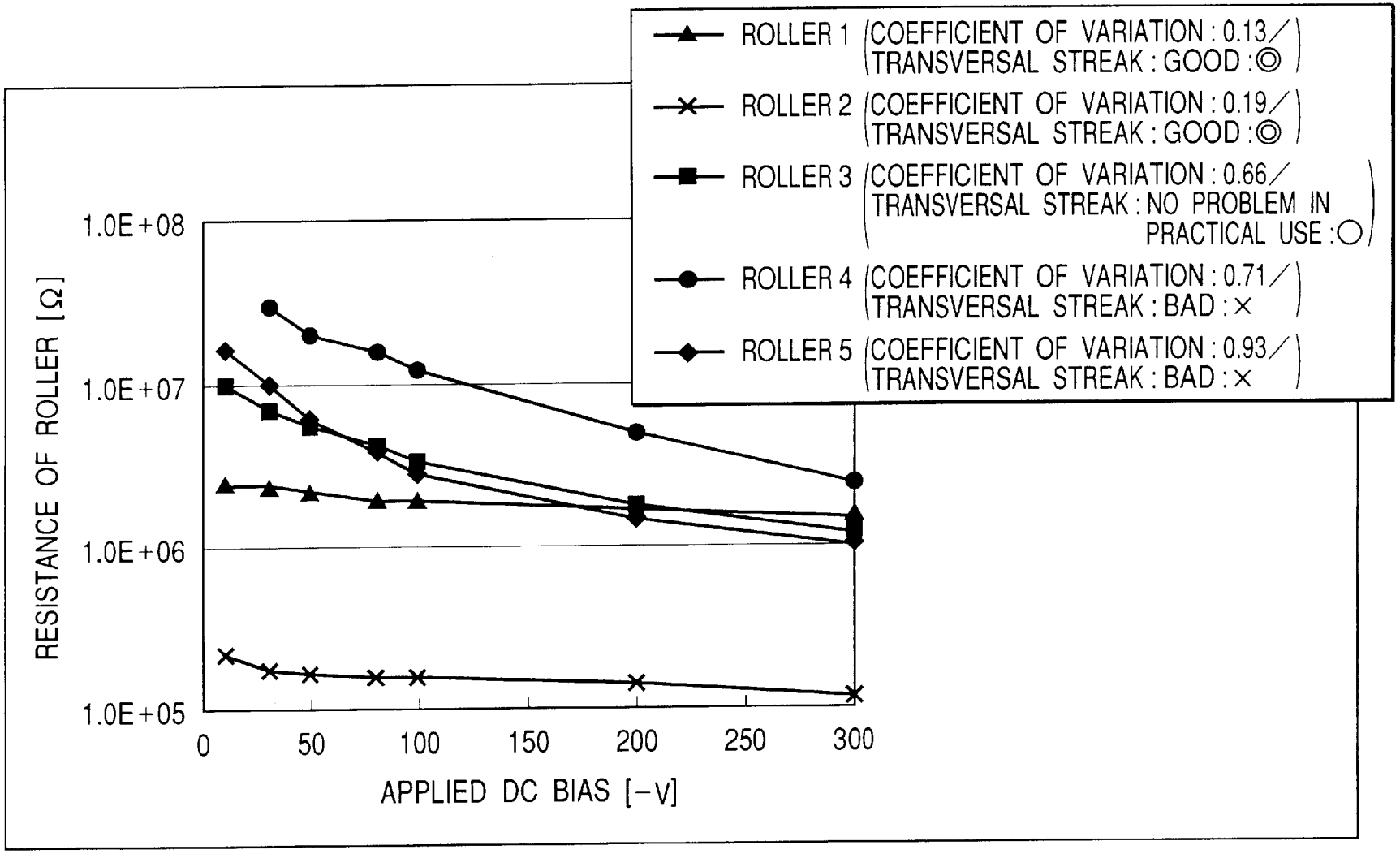
FIG. 4 is a graph showing a V-R characteristic of various charging rollers.

In the embodiment shown in FIG. 4, in the applied constant voltage $V_{DC}$=|10| to |300| (V), the measured V-R characteristics of the respective charging rollers are exhibited.

[Method of calculating the coefficient of variation S]

It is assumed that the roller resistance average value of the roller resistances Ri with respect to the respective applied voltages is Ra. Also, the standard deviation Z of the resistor R is obtained by the following expression (4).

$$Z=\sqrt{\frac{\sum(Ri-Ra)^2}{6}} \qquad \text{Expression (4)}$$

As a result, the coefficient of variation is obtained by the following expression (5).

$$S=Z/Ra \qquad \text{Expression (5)}$$

The coefficient of variation S is a value that is a standard of uniformity of the resistance.

Through the above-mentioned method of measuring the V-R characteristic of the charging roller, several kinds of the charging rollers in the embodiment and the conventional charging rollers are measured to evaluate the transversal streak unevenness, the current leakage to the fine defect of the photosensitive drum, and the charging performance under the L/L environment.

The results are exhibited in Table 1. In Table 1, the sign ⊙ represents good performance, the sign ○ represents no problem in practical use and the sign × represents bad performance. If the charging performance (convergent voltage−potential in one revolution of the drum) ensures 20 V or lower, there arises no problem on the image.

In the embodiment, rollers 1 and 2 are structured so as to provide a plurality of layers consisting of two layers, three layers or the like, and are made of NBR, epichlorohydrin rubber, urethane rubber, EPDM or the like, and the electrically conductive material in use is an ion electrically conductive base.

Conventional rollers 3 to 5 are structured so as to provide a plurality of layers consisting of two layers, three layers or the like, and are made of epichlorohydrin rubber, styrene-butadiene rubber, EPDM or the like, and the electrically conductive material in use is an electron conductive base.

As indicated by the rollers 1 and 2 of the embodiment and the conventional rollers 3 to 5, the coefficient of variation S and the image quality level (transversal streak) correlate. That is, it is proved that in a charging roller whose coefficient of variation S is 0.70 or less, a good image is obtained, and the transversal streak becomes more prominent and image quality deteriorates as the coefficient of variation becomes larger, that is, the charging roller resistance varies depending on the applied voltage.

In the conventional rollers 3 to 5, the potential of the photosensitive drum surface, which has been disturbed by the transferring portion under the L/L environments cannot be made uniform by the charging roller, and a transversal streak unevenness remarkably occurs when a halftone image is outputted.

Therefore, when the charging roller whose coefficient of variation S is 0.70 or less is used, a uniform halftone image can be obtained even using the d.c. charging method without using the charge eliminating means, such as the pre-exposure device, under the L/L environments.

Also, as indicated by the roller 2 of the embodiment, when the average value of the resistance Ra becomes smaller, the current leakage to the fine defect of the photosensitive drum occurs, and as indicated by the roller 3 of the embodiment, as the average value Ra of the resistance becomes larger, the charging performance level deteriorates. That is, if the average value of the roller resistance Ra is in a range of $6.7\times10^5$ (Ω)≦Ra≦$2.5\times10^6$ (Ω), any image trouble does not occur. It is better to set the coefficient of variation S at 0.1 or more.

TABLE 1

| | Measured value | | L/L environments: image trouble | | |
|---|---|---|---|---|---|
| | Coefficient of variation S | Roller resistance average value Ra (Ω) | Transversal streak charging unevenness | Photosensitive member/fine defect current leakage | Charging performance |
| Roller 1 (Present embodiment) | 0.13 | $1.23 \times 10^6$ | ⊙ | ○ | ○ |
| Roller 2 (Present embodiment) | 0.19 | $1.62 \times 10^5$ | ⊙ | X | ○ |
| Roller 3 (Conventional example) | 0.66 | $4.8 \times 10^6$ | ○ | ○ | X |
| Roller 4 (Conventional example) | 0.71 | $1.43 \times 10^7$ | X | ○ | X |
| Roller 5 (Conventional example) | 0.93 | $6.8 \times 10^6$ | X | ○ | ○ |

(3) Others (i) The image exposure means for electrostatic latent image formation is not limited to a laser scanning exposure means such as the printer of the embodiment. There may be used exposure means such as a normal analog-like image exposure or a light emitting element array such as LEDs or an exposure means obtained by the combination of light emitting elements such as a fluorescent lamp with a liquid crystal shutter so long as the electrostatic latent image corresponding to the image information can be formed.

(ii) The image bearing member is not limited to the photosensitive member but may be an electrostatic recording dielectric. In this case, after the dielectric surface has been uniformly primarily charged to a predetermined polarity, potential, charges are selectively eliminated from the dielectric surface by the charge eliminating means such as a charge eliminating needle head and an electron gun to form an electrostatic latent image.

(iii) The toner developing means of the electrostatic latent image may use a mono-component developer or a two-component developer. A regular developing means may be employed.

(iv) The transfer means may be a transfer belt type or a corona charger of the non-contact type.

(v) The recording material (transfer material) that is subjected to the transfer of the image toner from the image bearing member may be an intermediate transfer member such as a transfer drum or a transfer belt.

(vi) The image forming apparatus may be a cleaner-less system that develops and collects the transfer residual toner on the image bearing member at the same time without providing a cleaning device.

As was described above, according to the present invention, since the coefficient of variation S of the V-R characteristic is set to 0.7 or less, the charging uniformity in the d.c. charging, in particular, the transversal streak unevenness can be improved with a simple means and structure from which the charge eliminating means such as the pre-exposure device is omitted in the contact charging system using the d.c. charging system. Also, when the present invention is applied to the image forming apparatus, the uniform charging property without unevenness can be achieved even under the L/L environments with the simple structure from which the charge eliminating means such as the pre-exposure device is omitted when the halftone image is outputted. In addition, it is possible to prevent current leakage to the fine defect of a member to be charged and ensure satisfactory charging performance of $6.7\times10^5$ (Ω)≦Ra≦$2.5\times10^6$ (Ω). Also, in the process cartridge, there can be realized a structure excellent in the user friendly handling other than the above advantages.

The present invention is not limited to the above-mentioned embodiment, and any modification is possible within the scope of the technical concept of the present invention.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A charging member for charging a member to be charged, said charging member comprising:

an electrically conductive member to which a voltage is applicable; and a coating layer that coats said electrically conductive member, wherein when a d.c. voltage of |10| to |300| (V) is applied to said electrically conductive member, the following relationship is satisfied:

Z/Ra is 0.7 or less, where Z is a standard deviation of a resistance of said charging member, and Ra in Ω units is an average value of the resistance of said charging member.

2. A charging member according to claim 1, wherein said charging member is a charging roller.

3. A charging member according to claim 2, wherein said electrically conductive member is a core metal.

4. A charging member according to claim 1, wherein the average value Ra satisfies the following relationship:

$$6.7\times10^5\ (\Omega)\leqq Ra\leqq 2.5\times10^6\ \Omega).$$

5. A charging member according to claim 3, wherein the standard deviation Z and the average value Ra are obtained by:

using a measuring device comprising:

(a) a movable electrically conductive body;

(b) means for pressing said charging member against the movable electrically conductive body by a predetermined pressure;

(c) means for rotationally driving the movable electrically conductive body to rotate said charging member;

(d) a resistor of R(Ω) which connects the movable electrically conductive body and a grounded side of a voltage applying means for applying a plurality of d.c. constant voltages of |10| to |300| (V); and (e) voltage measuring means for measuring a voltage divided by the resistor, wherein the voltage applying means has a current amplification factor of 20 μA/V and a through-rate of 20 V/μsec or more;

applying a plurality of d.c. constant voltages E to said charging member by the voltage applying means under environments where the temperature is 12 to 17° C. and the humidity is 5 to 15%;

obtaining a current Ii per a contact area CA ($mm^2$) of said charging member with the movable electrically conductive body on the basis of a voltage Vr divided by the resistor of R(Ω) measured by the voltage measuring means in accordance with Ohm's law;

obtaining a resistance Ri of said charging member at the plurality of d.c. constant voltages by using Ri=(a divided voltage to said charging member: Vi=E−Vr)/(current value: (I);

plotting Vi on an abscissa axis and Ri on an ordinate axis to obtain a voltage-resistance characteristic of said charging member; and obtaining the standard deviation Z of the resistance of said charging member and the average value Ra of the resistance of said charging member within a range of |10| to |300| (V).

6. A charging member according to claim 1, wherein Z/Ra is equal to or larger than 0.1.

7. A charging member according to claim 1, wherein the member to be charged is an image bearing member, and the image bearing member and said charging member are disposed in a process cartridge detachably mountable onto a main body of an image forming apparatus.

8. A charging device comprising:

a charging member configured and positioned to charge a member to be charged, said charging member including an electrically conductive member and a coating layer that coats said electrically conductive member; and a power source configured and positioned to apply a d.c. voltage of a discharge start voltage or higher of the member to be charged and said charging member to said electrically conductive member, wherein when a d.c. voltage of |10| to |300| (V) is applied to said electrically conductive member, the following relationship is satisfied:

Z/Ra is 0.7 or less, wherein Z is a standard deviation of a resistance of said charging member, and Ra in Ω units is an average value of the resistance of said charging member.

9. A charging device according to claim 8, wherein said charging member is a charging roller.

10. A charging device according to claim 9, wherein said electrically conductive member is a core metal.

11. A charging device according to claim 8, wherein the average value Ra satisfies the following relationship:

$$6.7\times10^5\ (\Omega) \leqq Ra \leqq 2.5\times10^6\ \Omega).$$

12. A charging device according to claim 10, wherein the standard deviation Z and the average value Ra are obtained by:

using a measuring device comprising:

(a) a movable electrically conductive body;

(b) means for pressing said charging member against the movable electrically conductive body by a predetermined pressure;

(c) means for rotationally driving the movable electrically conductive body to rotate said charging member;

(d) a resistor of R(Ω) which connects the movable electrically conductive body and a grounded side of a voltage applying means for applying a plurality of d.c. constant voltages of |10| to |300| (V); and (e) voltage measuring means for measuring a voltage divided by the resistor, wherein the voltage applying means has a current amplification factor of 20 μA/V and a through-rate of 20 V/μsec or more;

applying a plurality of d.c. constant voltages E to said charging member by the voltage applying means under environments where the temperature is 12 to 17° C. and the humidity is 5 to 15%;

obtaining a current Ii per a contact area CA ($mm^2$) of said charging member with the movable electrically conductive body on the basis of a voltage Vr divided by the resistor of R(Ω) measured by the voltage measuring means in accordance with Ohm's law;

obtaining a resistance Ri of said charging member at said plurality of d.c. constant voltages by using Ri=(a divided voltage to said charging member: Vi=E−Vr)/(current value: (I);

plotting Vi on an abscissa axis and Ri on an ordinate axis to obtain a voltage-resistance characteristic of said charging member; and obtaining the standard deviation Z of the resistance of said charging member and the average value Ra of the resistance of said charging member within a range of |10| to |300| (V).

13. A charging device according to claim 8, wherein Z/Ra is equal to or larger than 0.1.

14. A charging device according to claim 8, wherein the member to be charged is an image bearing member, and the image bearing member and said charging member are disposed in a process cartridge detachably mountable onto a main body of an image forming apparatus.

15. A charging device according to claim 8, wherein a voltage applied by said power source ranges from 1,000 V to 1,500 V.

16. A charging device according to claim 8, wherein the member to be charged is a photosensitive member, and the photosensitive member is charged by said charging member without receiving pre-exposure after an image has been transferred from the photosensitive member onto an image receiving member.

17. A process cartridge detachably mountable to a main body of an image forming apparatus, said process cartridge comprising:

an image bearing member; and a charging member for charging a member to be charged, said charging member including an electrically conductive member to which a voltage is applicable and a coating layer that coats the electrically conductive member, wherein when a d.c. voltage of |10| to |300| (V) is applied to said electrically conductive member, the following relationship is satisfied:

Z/Ra is 0.7 or less, where Z is a standard deviation of a resistance of said charging member, and Ra in Ω units is an average value of the resistance of said charging member.

18. A process cartridge according to claim 17, wherein said charging member is a charging roller.

19. A process cartridge according to claim 18, wherein said electrically conductive member is a core metal.

20. A process cartridge according to claim 17, wherein the average value Ra satisfies the following relationship:

$$6.7\times10^5\ (\Omega)\leqq Ra\leqq 2.5\times10^6\ (\Omega).$$

21. A process cartridge according to claim 19, wherein the standard deviation Z and the average value Ra are obtained by:

using a measuring device comprising:

(a) a movable electrically conductive body;

(b) means for pressing said charging member against the movable electrically conductive body by a predetermined pressure;

(c) means for rotationally driving the movable electrically conductive body to rotate said charging member;

(d) a resistor of R(Ω) which connects the movable electrically conductive body and a grounded side of a voltage applying means for applying a plurality of d.c. constant voltages of |10| to |300| (V); and (e) voltage measuring means for measuring a voltage divided by the resistor, wherein the voltage applying means has a current amplification factor of 20 μA/V and a through-rate of 20 V/μsec or more;

applying a plurality of d.c. constant voltages E to said charging member by the voltage applying means under environments where the temperature is 12 to 17° C. and the humidity is 5 to 15%;

obtaining a current Ii per a contact area CA ($mm^2$) of said charging member with the movable electrically conductive body on the basis of a voltage Vr divided to said resistor of R(Ω) measured by the voltage measuring means in accordance with Ohm's law;

obtaining a resistance Ri of said charging member at said plurality of d.c. constant voltages by using Ri=(a divided voltage to said charging member; Vi=E−Vr)/(current value; (i); and plotting Vi on an abscissa axis and Ri on an ordinate axis to obtain a voltage-resistance characteristic of said charging member; and obtaining the standard deviation Z of the resistance of said charging member and the average value Ra of the resistance of said charging member within a range of |10| to |300| (V).

22. A process cartridge according to claim 17, wherein Z/Ra is equal to or larger than 0.1.

23. A process cartridge according to claim 17, wherein said image bearing member includes an electrically conductive base, a charge generation layer and a charge transport layer in the stated order from its inner side, and a capacitance per a unit area of 1 $cm^2$ of said charge transport layer ranges from 1.5 pF to 6.0 pF.

24. A process according to claim 17, wherein said image bearing member is a photosensitive member, and said photosensitive member is charged by said charging member without receiving pre-exposure after an image has been transferred from said photosensitive member onto an image receiving member.

* * * * *

UNITED STATES PATENT AND TRADEMARK OFFICE

CERTIFICATE OF CORRECTION

PATENT NO. : 6,625,412 B2
DATED : September 23, 2003
INVENTOR(S) : Norio Takami et al.

It is certified that error appears in the above-identified patent and that said Letters Patent is hereby corrected as shown below:

Column 1,
Line 59, ""d.c." should read -- the "d.c. --.
Line 61, ""a.c." should read -- the "a.c. --.

Column 2,
Line 29, "environments")?" should read -- environments"), --.

Column 3,
Line 40, "layer is" should read -- layer from --.

Column 10,
Line 64, "$6.7x10^5(\Omega)\leq R2\leq 2.5x10^6\Omega)$." should read -- $6.7x10^5(\Omega)\leq R2\leq 2.5x10^6(\Omega)$. --.

Column 12,
Line 5, "$6.7x10^5(\Omega)\leq R2\leq 2.5x10^6\Omega)$." should read -- $6.7x10^5(\Omega)\leq R2\leq 2.5x10^6(\Omega)$. --.
Line 39, "(I);" should read -- Ii); --.

Column 14,
Line 15, "(i);" should read -- Ii); --.
Line 31, "process" should read -- process cartridge --.

Signed and Sealed this

Thirteenth Day of April, 2004

JON W. DUDAS
*Acting Director of the United States Patent and Trademark Office*